US005864103A

United States Patent [19]

Koeppe, Jr. et al.

[11] Patent Number: 5,864,103

[45] Date of Patent: Jan. 26, 1999

[54] LIMIT SWITCH APPARATUS FOR HYDRAULIC ELEVATORS

[75] Inventors: Robert J. Koeppe, Jr., Newton; Ronald G. Singletary, Hillside; Alan J. Raite, Sewaren, all of N.J.

[73] Assignee: Inventio AG, Hergiswil, Switzerland

[21] Appl. No.: 901,094

[22] Filed: Jul. 28, 1997

[51] Int. Cl.[6] ..... B66B 1/28

[52] U.S. Cl. ..... 187/294; 187/302; 187/282

[58] Field of Search ..... 187/394, 284, 187/285, 294, 283, 302

[56] References Cited

U.S. PATENT DOCUMENTS

| | | | |
|---|---|---|---|
| 1,169,722 | 1/1916 | Jansson | 187/302 |
| 4,127,843 | 11/1978 | Anzai et al. | 340/21 |
| 4,775,032 | 10/1988 | Peelle, III | 187/394 |
| 4,787,481 | 11/1988 | Farrar et al. | 187/110 |

FOREIGN PATENT DOCUMENTS

| | | | |
|---|---|---|---|
| 2262396 | 6/1974 | Germany . | |
| 37 04 291 | 8/1988 | Germany . | |
| 52-61041 | 5/1977 | Japan | 187/394 |
| 4-350075 | 12/1992 | Japan | 187/294 |
| 5-319716 | 12/1993 | Japan | 187/294 |
| 06211448 | 8/1994 | Japan . | |

*Primary Examiner*—Robert Nappi

*Attorney, Agent, or Firm*—MacMillan, Sobanski & Todd, LLC

[57] ABSTRACT

An apparatus for generating function signals to an elevator controller for controlling an elevator car (1) at terminal landings in a building includes an upper cam (3) and a lower cam (4) for mounting on a wall (2*a*, 2*b*) in an elevator shaft (2) at a top landing and a bottom landing respectively, an upper switch (5) and a lower switch (8) for mounting on the elevator car and for connection to a source of electrical power (12) and an interface circuit (10) connected to the switches. The interface circuit (10) has a lower limit relay coil (16), an upper limit relay coil (27), normally closed up relay contact sets (17,19,35) and normally closed down relay contact sets (24,28,30) which cooperate with the switches (5,8) for generating upper and lower limit function signals to control car travel and upper and lower slow down signals to control car speed.

14 Claims, 5 Drawing Sheets

Fig. 4

TABLE OF BYPASS SIGNAL GENERATION

| | USD/DL | DSD/UL | BPU | BPD |
|---|---|---|---|---|
| Top Limit | open | open | 0 | 1 |
| Top Slow Down | open | closed | 0 | 1 |
| Hoistway | closed | closed | 0 | 0 |
| Bottom Slow Down | closed | open | 1 | 0 |
| Bottom Limit | open | open | 1 | 0 |

Table Key

BPU := By Pass Up = Allow movement in the UP direction
BPD := By Pass Down = Allow movement in the DOWN direction
BPU & BPD Active one := +5 VDC
BPU & BPD Inactive zero := 0 VDC
Relay input R := Released, NOT Energized
Relay input PICKED := Energized

Fig. 5

| INPUTS | | | | | OUTPUTS | | | |
|---|---|---|---|---|---|---|---|---|
| COMMAND | RELAY UP | RELAY DOWN | A USD/DL | B UL/DSD | BPU | BPD | KUL | KLL |
| IDLE | R | R | OPEN | OPEN | 0 | ACTIVE "ONE" | OPEN | CL |
| | R | R | OPEN | CL | 0 | ACTIVE "ONE" | CL | CL |
| | R | R | CL | CL | 0 | 0 | CL | CL |
| | R | R | CL | OPEN | ACTIVE "ONE" | 0 | CL | CL |
| | R | R | OPEN | OPEN | ACTIVE "ONE" | 0 | CL | OPEN |
| DOWN | R | PICKED | OPEN | OPEN | 0 | ACTIVE "ONE" | OPEN | CL |
| | R | PICKED | OPEN | CL | 0 | ACTIVE "ONE" | OPEN | CL |
| | R | PICKED | CL | CL | 0 | 0 | OPEN | CL |
| | R | PICKED | CL | OPEN | ACTIVE "ONE" | 0 | OPEN | CL |
| | R | PICKED | OPEN | OPEN | ACTIVE "ONE" | 0 | OPEN | OPEN |
| UP | PICKED | R | OPEN | OPEN | 0 | ACTIVE "ONE" | OPEN | OPEN |
| | PICKED | R | OPEN | CL | 0 | ACTIVE "ONE" | CL | OPEN |
| | PICKED | R | CL | CL | 0 | 0 | CL | OPEN |
| | PICKED | R | CL | OPEN | ACTIVE "ONE" | 0 | CL | OPEN |
| | PICKED | R | OPEN | OPEN | ACTIVE "ONE" | 0 | CL | OPEN |
| BOTH | PICKED | PICKED | OPEN | OPEN | 0 | ACTIVE "ONE" | OPEN | OPEN |
| | PICKED | PICKED | OPEN | CL | 0 | ACTIVE "ONE" | OPEN | OPEN |
| | PICKED | PICKED | CL | CL | 0 | 0 | OPEN | OPEN |
| | PICKED | PICKED | CL | OPEN | ACTIVE "ONE" | 0 | OPEN | OPEN |
| | PICKED | PICKED | OPEN | OPEN | ACTIVE "ONE" | 0 | OPEN | OPEN |

LIMIT SWITCH APPARATUS FOR HYDRAULIC ELEVATORS

BACKGROUND OF THE INVENTION

The present invention relates generally to hydraulic elevators and, in particular, to a limit switch apparatus for use with hydraulic elevator cars.

Typically, limit switches for use with hydraulic elevators are mounted in stacks at each terminal landing on the wall of the elevator shaft. These terminal limit switch stacks provide normal terminal stopping, emergency terminal slowdown, and limit functions as required by code. The number of switches used depends upon the provisions of the elevator code governing the installation (such as A17.1, CSA, or local) and the car speed. For example, a maximum of seven switches may be required for some installations and a minimum of four switches for other installations. The switches are mounted in the elevator shaft at each terminal landing and are actuated by a car mounted cam. Each switch has a specific function and a sequence of operation.

In some installations, the terminal limit switches are mounted on the car by transferring the upper and lower terminal limit switch stacks from the elevator shaft wall to the exterior of the car. The German patent document 2 262 396 shows car mounted position indicators which are activated by a cam or a magnet wherein different levels used for different operating modes are detected.

The German patent document 37 04 291 shows a hydraulic elevator car having limit switches mounted thereon which switches are activated by shaft mounted magnets for detecting floor levels.

SUMMARY OF THE INVENTION

The present invention concerns an apparatus for generating function signals to an elevator controller for controlling an elevator car at terminal landings in a building. The apparatus includes: an upper cam and a lower cam for mounting on a wall in an elevator shaft at a top landing and a bottom landing respectively; an upper switch and a lower switch for mounting on an elevator car traveling in the elevator shaft; and an interlock circuit having inputs for connection to a controller associated with the elevator for receiving an up direction signal representing an upward direction of travel of the elevator car in the elevator shaft and a down direction signal representing a downward direction of travel of the elevator car in the elevator shaft, the interlock circuit being connected to the upper switch and to the lower switch, and the interlock circuit having outputs for connection to the controller for generating function signals whereby when the upper and lower cams are mounted on the wall of the elevator shaft at the top landing and the bottom landing respectively and the upper and lower switches are mounted on the elevator car in vertically spaced apart relationship, the interlock circuit responds to the up direction signal and actuation of the upper switch by the upper cam to generate an up slowdown function signal for controlling the elevator car speed, the interlock circuit responds to the up direction signal and actuation of the lower switch by the upper cam to generate an up limit function signal for controlling the elevator car travel, the interlock circuit responds to the down direction signal and actuation of the upper switch by the lower cam to generate a down limit function signal for controlling the elevator car travel, and the interlock circuit responds to the down direction signal and actuation of the lower switch by the lower cam to generate a down slowdown function signal for controlling the elevator car speed.

It is an object of the present invention to reduce the number of limit switches required in an elevator hoistway for terminal control of the elevator car.

It is another object of the present invention to reduce the amount of wiring in an hydraulic elevator installation.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which:

FIG. 4 is a table of the states of the single stack logic block shown in the FIG. 3; and FIG. 5 is a table of the states of the single stack logic block shown in the FIG. 3.

DESCRIPTION OF THE PREFERRED EMBODIMENT

Depending upon the code requirements and the car speed, a hydraulic elevator can require as many as seven limit switches. At the top landing, these switches can include in order of actuation: up slowdown (USD), first emergency terminal slowdown (ETS1), second emergency terminal slowdown (ETS2), and up limit (UL). At the bottom landing, these switches can include in order of actuation: down slowdown (DSD), third emergency terminal slowdown (ETS3), and down limit (DL).

The present invention mounts a single limit switch stack on an elevator car. A cam is positioned in the hoistway at each terminal landing. Thus, the limit switch equipment is easier to install and there is a reduction in the total number of cables to be run to the elevator controller. The up slowdown (USD) and down limit (DL) functions are combined into one switch using the relays for the high speed up/down valve solenoids to determine the correct switch function (USD or DL). The down slowdown (DSD) and up limit (UL) functions are similarly combined into a single switch. The present invention utilizes a system of electrical interlocks which allows a reduction in the number of limit switches required to a maximum of five and a minimum of two. The USD and DL functions are combined in one switch and the DSD and UL functions can be combined in another switch.

In order to combine the functions identified above, two obstacles must be overcome. One obstacle is knowing which direction the car is moving so that the correct function is selected, and the second obstacle is running multiple circuits or voltages through the same choke point, the limit switch. Both of these obstacles are overcome by utilizing an electrical interlock.

The elevator car can only move in the up direction if the high and/or low speed "up" circuits of the hydraulic system control valve are open. Barring a hydraulic line rupture, the elevator car can only move in the down direction if the high and/or low speed "down" circuits of the control valve are open. The interlock circuit defines which function (USD or DL, UL or DSD) the limit switches operate. A second purpose of the interlock circuit is to isolate the two functions of each limit switch, thus allowing multiple circuits and voltages to run through the same limit switch.

Figure 1:
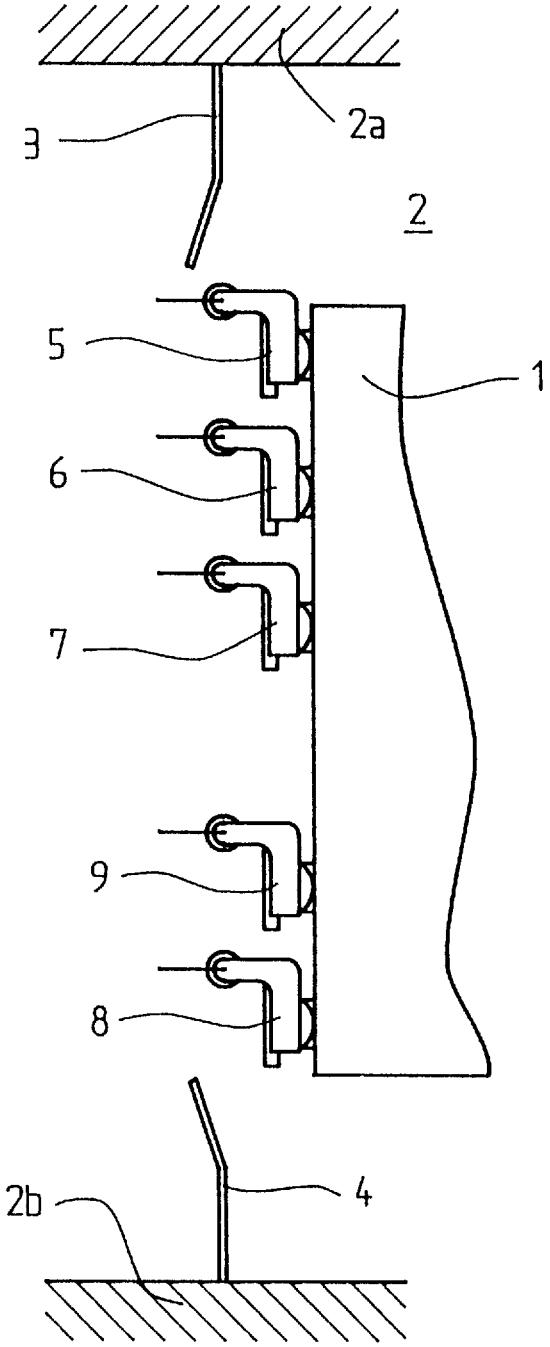
FIG. 1 is a fragmentary elevation view of an hydraulic elevator car having a limit switch apparatus in accordance with the present invention mounted thereon.

There is shown in the FIG. 1 a hydraulic elevator car 1 movable in a generally vertical direction in an elevator shaft 2. An upper (up) cam 3 and a lower (down) cam 4 are mounted on a wall in the elevator shaft 2 adjacent a path of travel of the car 1. The upper cam 3 is mounted on a shaft wall first portion 2*a* at the top landing and the lower cam 4 is mounted on a shaft wall second portion 2*b* at the bottom landing.

A plurality of normally closed limit switches are mounted on an exterior side wall of the car 1 for actuation by the cams 3 and 4. A first or uppermost switch 5 is mounted on the car 1 adjacent an upper end thereof and performs the functions of up slowdown (USD) and down limit (DL). A second switch 6 is mounted on the car 1, a predetermined distance below the first switch 5, and performs the function of first emergency terminal slowdown (ETS1). A third switch 7 is mounted on the car 1, a predetermined distance below the second switch 6, and performs the function of second emergency terminal slowdown (ETS2). A fourth or lowermost switch 8 is mounted on the car 1 adjacent a lower end thereof and performs the functions of down slowdown (DSD) and up limit (UL). A fifth switch 9 is mounted on the car 1, a predetermined distance above the fourth switch 8, and performs the function of third emergency terminal slowdown (ETS3). The two switches 5 and 8 replace four separate switches required by the prior art elevator limit switch controls.

Figure 2:
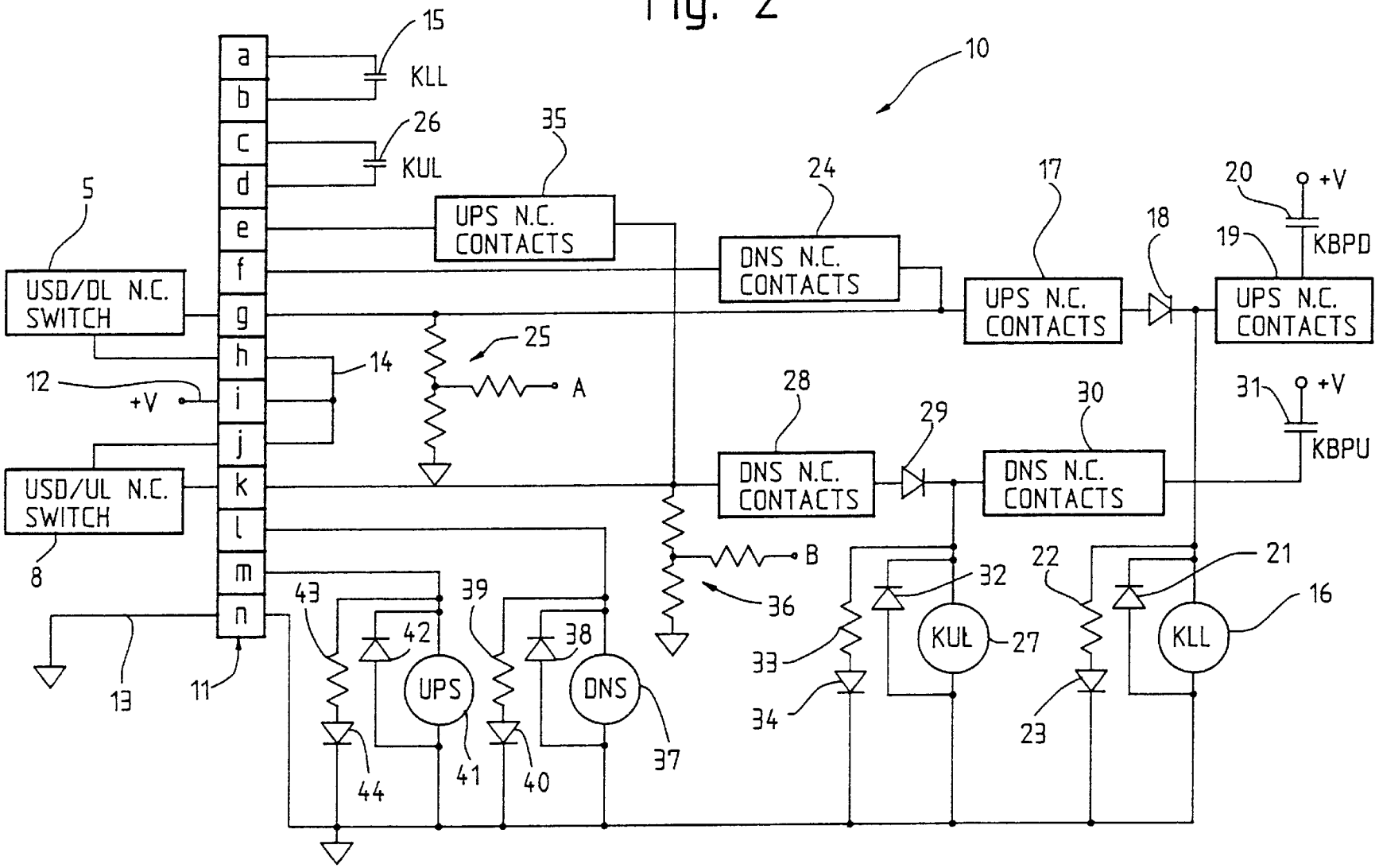
FIG. 2 is schematic diagram of the control circuit for the limit switch apparatus shown in the FIG. 1.

There is shown in the FIG. 2 an interlock circuit 10 for defining the functions performed by the switches 5 and 8 according to the present invention. The interlock circuit 10 is connected to a power supply (not shown) and to the normally closed switches 5 and 8 by a terminal strip 11 having a plurality of terminals 11*a* through 11*n*. A power input line 12 is connected to a terminal 11*i* of the terminal strip 11 for receiving positive polarity electrical power of any suitable voltage (+V) and a power return line 13 for the power is connected to the terminal 11*n*. The terminal 11*i* is connected by a power distribution line 14 in the circuit 10 to a pair of terminals 11*h* and 11*j*. The terminal 11*h* is connected through the first switch 5 to a terminal 11*g* and the terminal 11*j* is connected through the fourth switch 8 to a terminal 11*k*. Thus, electrical power and the status of the switches 5 and 8, open or closed, are inputs to the interlock circuit 10 at the terminals 11*g* and 11*k*.

A pair of normally open relay contacts 15 of a lower limit (KLL) relay are connected between the terminal 11*a* and a terminal 11*b* which terminals are connected to the elevator controller (not shown). The contacts 15 are controlled by a lower limit (KLL) relay coil 16 having one lead connected to the ground terminal 11*n* and another lead connected to the terminal 11*g* through a normally closed up relay first contact set (UPS) 17. An anode of an isolation diode 18 is connected to the contact set 17 and a cathode is connected to the coil 16. The junction of the relay coil lead and the diode cathode is connected to a +V power supply terminal through a normally closed up relay second contact set 19 and a pair of normally open KBPD relay contacts 20. A diode 21 is connected across the relay coil 16 and poled opposite to the +V power supply to dissipate the collapsing field when the switch 5 is opened. A resistor 22 and a light emitting diode 23 are connected in series across the relay coil 16 to provide a visual indication that current is flowing through the relay coil. A normally closed down relay first contact set (DNS) 24 is connected between the terminal 11*g* and a terminal 11*f*. Further, a first voltage divider resistor network 25 is connected between the terminal 11*g* and the system ground for generating a scaled signal at a terminal A.

A pair of normally open relay contacts 26 of an upper limit (KUL) relay are connected between a terminal 11*c* and a terminal 11*d* which terminals are connected to the elevator controller (not shown). The contacts 26 are controlled by an upper limit (KUL) relay coil 27 having one lead connected to the ground terminal 11*n* and another lead connected to the terminal 11*k* through a normally closed down relay second contact set (DNS) 28. An anode of an isolation diode 29 is connected to the contact set 28 and a cathode is connected to the coil 27. The junction of the relay coil lead and the diode cathode is connected to a +V power supply terminal through a normally closed up relay third contact set 30 and a pair of normally open KBPU relay contacts 31. A diode 32 is connected across the relay coil 27 and poled opposite to the +V power supply to dissipate the collapsing field when the switch 8 is opened. A resistor 33 and a light emitting diode 34 are connected in series across the relay coil 27 to provide a visual indication that current is flowing through the relay coil. A normally closed up relay third contact set (UPS) 35 is connected between a terminal 11*e* and the terminal 11*k*. Further, a second voltage divider resistor network 36 is connected between the terminal 11*k* and the system ground for generating a scaled signal at a terminal B.

A down direction of travel relay coil (DNS) 37 is connected between the terminal 11*n* and a terminal 11*l* for receiving a direction of travel signal in the form of electrical power during downward travel of the car 1. A diode 38 is connected across the relay coil 37 and poled opposite to the +V power supply to dissipate the collapsing field when power is disconnected. A resistor 39 and a light emitting diode 40 are connected in series across the relay coil 37 to provide a visual indication that current is flowing through the relay coil. An up direction of travel relay coil (UPS) 41 is connected between the terminal 11*n* and a terminal 11*m* for receiving a direction of travel signal in the form of electrical power during upward travel of the car 1. A diode 42 is connected across the relay coil 41 and poled opposite to the +V power supply to dissipate the collapsing field when power is disconnected. A resistor 43 and a light emitting diode 44 are connected in series across the relay coil 41 to provide a visual indication that current is flowing through the relay coil.

Figure 3:
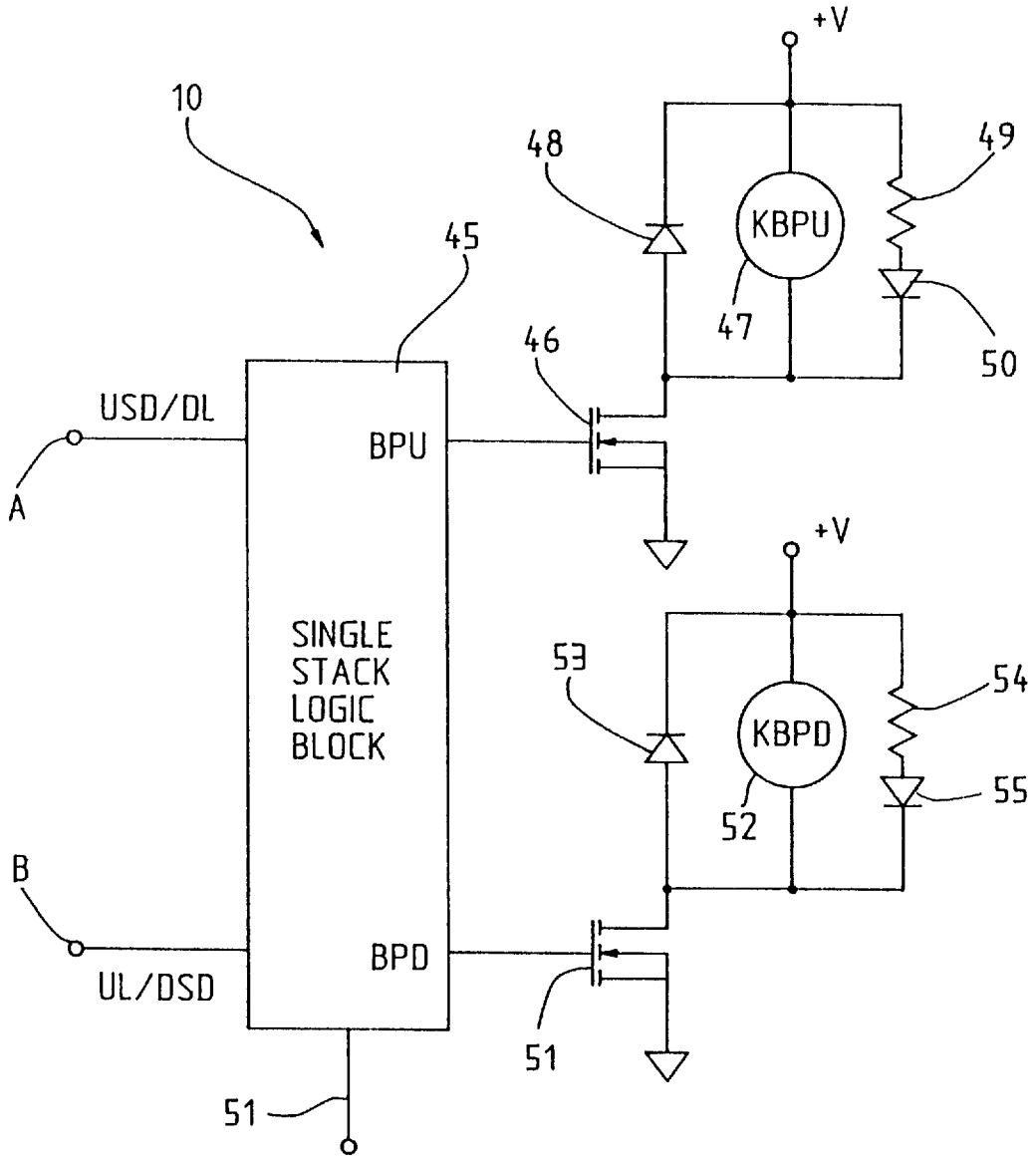
FIG. 3 is a continuation of the schematic diagram shown in the FIG. 2.

The interlock circuit 10 is continued in the FIG. 3 wherein the terminals A and B are connected to inputs to a single stack logic block 45. The logic block 45 has a BPU output connected to a gate of a first field effect transistor (FET) 46. The FET 46 and a relay coil (KBPU) 47 are connected in series between the +V power supply terminal and the system ground. A diode 48 is connected across the relay coil 47 and poled opposite to the +V power supply to dissipate the collapsing field when power is disconnected. A resistor 49 and a light emitting diode 50 are connected in series across the relay coil 47 to provide a visual indication that current is flowing through the relay coil. The logic block 45 also has a BPD output connected to a gate of a second FET 51. The FET 51 and a relay coil (KBPD) 52 are connected in series between the +V power supply terminal and the system ground. A diode 53 is connected across the relay coil 52 and poled opposite to the +V power supply to dissipate the collapsing field when power is disconnected. A resistor 54 and a light emitting diode 55 are connected in series across the relay coil 52 to provide a visual indication that current is flowing through the relay coil.

The up direction valves (not shown) for the elevator hydraulic circuit are controlled by the KUL relay 27 and its contacts 26. The down direction valves (not shown) for the elevator hydraulic circuit are controlled by the KLL relay 16 and its contacts 15. Command signals from the elevator controller either activate an UP relay (not shown) and, via the terminal 11*m*, activate the UPS relay 41, or activate a DN relay (not shown) and, via the terminal 11*l*, activate the DNS relay 37. The normally closed contact sets 17, 19, 24, 28, 30 and 35 function as steering contacts to multiplex the input signals from the first switch (USD/DL) 5 and the fourth switch (DSD/UL) 8.

An up direction of travel is initiated by the controller generating a signal at the terminal 11*m* to energize the relay coil (UPS) 41 and open the normally closed contact sets 17, 19 and 35. Now the USD/DL switch 5 feeds power to a high speed relay circuit through the normally closed contact set 24 of the DNS relay. Meanwhile, the DSD/UL switch 8 can only feed power to the KUL relay coil 27 via the normally closed contact set 28 of the DNS relay and the isolation diode 29.

A down direction of travel is initiated by the controller generating a signal at the terminal 11*l* to energize the relay coil (DNS) 37 and open the normally closed contact sets 24, 28 and 30. Now the DSD/UL switch 8 feeds power to the high speed relay circuit through the normally closed contact set 35 of the UPS relay. Meanwhile, the USD/DL switch 5 can only feed power to the KLL relay coil 16 via the normally closed contact set 17 of the UPS relay and the isolation diode 18.

A problem would develop when the elevator car 1 attempts to leave either the upper terminal or the lower terminal. If the car has traveled to the uppermost terminal, that means that the limit switches would have been defined as USD 8 and UL 5, ending the trip with USD open and UL closed. For the return trip to take place, the switches change definition and become DL 5 and DSD 8. In this reversed state, DL 5 is open and DSD is closed such that the car cannot move. To overcome this problem, a pair of bypass signals must be generated which allow the car to either move up from the bottom terminal or bottom limit, or to move down from the top terminal or top limit.

The logic block 45 shown in the FIG. 3 generates a bypass up (BPU) signal (bottom limit) and a bypass down (BPD) signal (top limit) utilizing the scaled voltages from the switches 5 and 8 which are applied to the A and B terminals respectively. The BPU signal turns on the FET 46 to activate the KBPU relay coil 47 and close the KBPU contacts 31 thereby applying power to the KUL relay coil 27 through the normally closed contact set 30. The BPD signal turns on the FET 51 to activate the KBPD relay coil 52 and close the KBPD contacts 20 thereby applying power to the KLL relay coil 16 through the normally closed contact set 19. The isolation diodes 18 and 29 isolate the inputs of the logic block 45 from the signals generated when the KBPD contacts 20 and the KBPU contacts 31 are closed.

The states of the input signals from the switches 5 and 8 and the bypass signals BPU and BPD generated by the single stack logic block 45 are shown in a table in the FIG. 4. The USD/DL switch 5 and the DSD/UL switch 8 generate five different input signal combinations at the terminals A and B. At the top limit and the bottom limit, both of the switches 5 and 8 are open. The correct BPU and BPD output signals are generated by utilizing the logic block 45 to sense which of the switches changes from closed to open first. If the USD/DL switch 5 opened first, the car must be in the top of the shaft 2 and the BPD signal is generated by the logic block 45. If the DSD/UL switch 8 opened first, the car must be in the bottom of the shaft 2 and the BPU signal is generated by the logic block 45.

If both the up and down commands are generated at the same time, the logic block 45 will disable any movement. This operation is evident from the information shown in the table of the FIG. 5 which also shows the states of the up and down relays and the KUL and KLL relay coils.

Another problem could occur when power is first applied to the circuit 10. The elevator controller and the single stack logic block 45 must be synchronized to the actual position of the car 1 in the shaft 2. If the power is applied when the car is at either limit position, the controller and the logic block can "wake up" in the wrong state. To overcome such a condition, an additional signal must be generated to indicate at which limit the car is positioned. Such a signal can be generated from the landing system or an additional switch at an input 51 to the logic block 45.

In summary, the present invention concerns an apparatus for generating function signals to an elevator controller for controlling the elevator car 1 at terminal landings in a building. The apparatus includes: the upper cam 3 and the lower cam 4 for mounting on a wall 2*a* and 2*b* in the elevator shaft 2 at a top landing and a bottom landing respectively; the upper switch 5 and the lower switch 8 for mounting on the elevator car travelling in the elevator shaft; and the interlock circuit 10 having inputs 11*m*, 11*l* for connection to a controller associated with the elevator for receiving an up direction signal representing an upward direction of travel of the elevator car in the elevator shaft and a down direction signal representing a downward direction of travel of the elevator car in the elevator shaft, the interlock circuit being connected to the upper switch and to the lower switch, and the interlock circuit having outputs 11*a*–11*f* for connection to the controller for generating function signals whereby when the upper and lower cams are mounted on the wall of the elevator shaft at the top landing and the bottom landing respectively and the upper and lower switches are mounted on the elevator car in vertically spaced apart relationship, the interlock circuit responds to the up direction signal and actuation of the upper switch by the upper cam to generate an up slowdown function signal for controlling the elevator car speed, the interlock circuit responds to the up direction signal and actuation of the lower switch by the upper cam to generate an up limit function signal for controlling the elevator car travel, the interlock circuit responds to the down direction signal and actuation of the upper switch by the lower cam to generate a down limit function signal for controlling the elevator car travel, and the interlock circuit responds to the down direction signal and actuation of the lower switch by the lower cam to generate a down slowdown function signal for controlling the elevator car speed.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An apparatus for generating function signals to an elevator controller for controlling an elevator car at terminal landings comprising:

an upper cam means and a lower cam means for mounting on a wall in an elevator shaft at a top landing and a bottom landing respectively;

an upper switch means and a lower switch means for mounting on an elevator car travelling in the elevator shaft; and an interlock means having inputs for connection to a controller associated with the elevator for receiving an up direction signal representing an upward direction of travel of the elevator car in the elevator shaft and a down direction signal representing a downward direction of travel of the elevator car in the elevator shaft, said interlock means being connected to said upper switch means and to said lower switch means, and said interlock means having outputs for connection to the controller for generating function signals whereby when said upper and lower cam means are mounted on the wall of the elevator shaft at the top landing and the bottom landing respectively and said upper and lower switch means are mounted on the elevator car in vertically spaced apart relationship, said interlock means responds to the up direction signal and actuation of said upper switch means by said upper cam means to generate an up slowdown function signal for controlling the elevator car speed, said interlock means responds to the up direction signal and actuation of said lower switch means by said upper cam means to generate an up limit function signal for controlling the elevator car travel, said interlock means responds to the down direction signal and actuation of said upper switch means by said lower cam means to generate a down limit function signal for controlling the elevator car travel, and said interlock means responds to the down direction signal and actuation said of lower switch means by said lower cam means to generate a down slowdown function signal for controlling the elevator car speed.

2. The apparatus according to claim 1 wherein said interlock means includes a lower limit relay coil and an up direction of travel relay coil having a set of normally closed contacts connected between said upper switch means and said lower limit relay coil, said up direction of travel relay coil being responsive to the up direction signal for opening said contacts during upward travel of the elevator car.

3. The apparatus according to claim 1 wherein said interlock means includes an upper limit relay coil and a down direction of travel relay coil having a set of normally closed contacts connected between said lower switch means and said upper limit relay coil, said down direction of travel relay coil being responsive to the down direction signal for opening said contacts during downward travel of the elevator car.

4. The apparatus according to claim 1 wherein said interlock means includes a logic means connected to said upper switch means and to said lower switch means, said logic means being responsive to actuation of said upper and lower switch means for generating bypass signals representing a sequence of actuation of said upper and lower switch means by said upper and lower cam means.

5. The apparatus according to claim 4 wherein said logic means is responsive to actuation of said upper switch means before actuation of said lower switch means for generating said bypass signals as a logic "0" bypass up signal and a logic "1" bypass down signal.

6. The apparatus according to claim 4 wherein said logic means is responsive to actuation of said lower switch means before actuation of said upper switch means for generating said bypass signals as a logic "1" bypass up signal and a logic "0" bypass down signal.

7. The apparatus according to claim 4 wherein said logic means includes a bypass up relay coil having a pair of normally open contacts connected between a power source and an upper limit relay coil and being responsive to actuation of said lower switch means before actuation of said upper switch means for closing said contacts.

8. The apparatus according to claim 4 wherein said logic means includes a bypass down relay coil having a pair of normally open contacts connected between a power source and a lower limit relay coil and being responsive to actuation of said upper switch means before actuation of said lower switch means for closing said contacts.

9. An apparatus for controlling an elevator car at terminal landings comprising:

an upper cam and a lower cam for mounting on a wall in an elevator shaft at a top landing and a bottom landing respectively;

an upper switch and a lower switch for mounting on an elevator car travelling in the elevator shaft; and an interlock means for connection to a controller of the elevator car, said interlock means being connected to said upper switch and to said lower switch and having an input for connection to an electrical power source, said interlock means further comprising:

a lower limit relay coil and a normally closed up relay contact set connected in series with said upper switch for closing a pair of lower limit contacts when said upper switch is actuated by said lower cam during downward travel of the elevator car;

a normally closed down relay contact set connected in series with said upper switch for generating an up slow down signal for controlling the elevator car when said upper switch is actuated by said upper cam during upward travel of the elevator car;

a upper limit relay coil and another normally closed down relay contact set connected in series with said lower switch for closing a pair of upper limit contacts when said lower switch is actuated by said upper cam during upward travel of the elevator car; and another normally closed up relay contact set connected in series with said lower switch for generating a down slow down signal for controlling the elevator car when said lower switch is actuated by said lower cam during downward travel of the elevator car.

10. The apparatus according to claim 9 wherein said each of said upper limit relay coil and said lower limit relay coil have an associated light emitting diode connected in parallel therewith for indicating current flow through said relay coils.

11. The apparatus according to claim 9 including an up direction relay coil responsive to an up direction signal received from the elevator controller and for actuating said up relay contact sets to an open position during upward travel of the elevator car.

12. The apparatus according to claim 9 including a down direction relay coil responsive to a down direction signal received from the elevator controller and for actuating said down relay contact sets to an open position during downward travel of the elevator car.

13. An apparatus for generating limit function signals to an elevator controller for controlling an elevator car at terminal landings comprising:

an upper cam and a lower cam for mounting on a wall in an elevator shaft at a top landing and a bottom landing respectively;

an upper switch and a lower switch for mounting on an elevator car travelling in the elevator shaft and for connection to a source of electrical power;

a lower limit relay coil and a normally closed up relay contact set connected in series with said upper switch and a pair of lower limit relay contacts actuated to a closed position when electrical current is flowing through said lower limit relay coil for generating a down limit function signal for controlling the elevator car travel when said upper switch is actuated by said lower cam during downward travel of the elevator car;

a down relay contact set connected in series with said upper switch for generating an up slow down function signal for controlling the elevator car speed when said upper switch is actuated by said upper cam during upward travel of the elevator car;

an upper limit relay coil and another down relay contact set connected in series with said lower switch and a pair of upper limit relay contacts actuated to a closed position when electrical current is flowing through said upper limit relay coil for generating an up limit function signal for controlling the elevator car travel when said lower switch is actuated by said upper cam during upward travel of the elevator car; and another up relay contact set connected in series with said lower switch for generating a down slow down function signal for controlling the elevator car speed when said lower switch is actuated by said lower cam during downward travel of the elevator car.

14. The apparatus according to claim 13 including an up direction relay coil for receiving electrical current from the elevator controller and for actuating said up relay contact sets to an opened position in response to electrical current flowing through said up direction relay coil and a down direction relay coil for receiving electrical current from the elevator controller and for actuating said down relay contact sets to an opened position in response to electrical current flowing through said down direction relay coil.

* * * * *